US006332788B1

(12) United States Patent
Okabe et al.

(10) Patent No.: US 6,332,788 B1
(45) Date of Patent: Dec. 25, 2001

(54) LEVER FITTING-TYPE CONNECTOR WITH DIVISION CONNECTORS

(75) Inventors: Toshiaki Okabe, Shizuoka; Masanori Wakui, Aichi, both of (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/497,484

(22) Filed: Feb. 4, 2000

(30) Foreign Application Priority Data

Feb. 8, 1999 (JP) ..... 11-030519

(51) Int. Cl.[7] ..... H01R 13/62
(52) U.S. Cl. ..... 439/157; 439/701
(58) Field of Search ..... 439/157, 701

(56) References Cited

U.S. PATENT DOCUMENTS 5,454,733 * 3/1995 Watanabe et al. ..... 439/540.1
5,879,201 * 3/1999 Fukamachi et al. ..... 439/752
5,913,703 * 6/1999 Suzuki et al. ..... 439/701

FOREIGN PATENT DOCUMENTS

08115766A * 7/1996 (JP) .
10-125394 5/1998 (JP) .
10-241773 * 9/1998 (JP) .
10-241801 9/1998 (JP) .
2000-331738 * 11/2000 (JP) .

* cited by examiner

*Primary Examiner*—Brian Sircus
*Assistant Examiner*—Michael C. Zarroli
(74) *Attorney, Agent, or Firm*—Morgan, Lewis& Bockius LLP

(57) ABSTRACT

A lever 22 is pivotally mounted on bosses 29 formed on a connector 21, and the connector 21 is fitted into a mating connector 23 by pivotally moving the lever 22 about the bosses 29. The connector 21 is formed by a plurality of division connectors 24, 25 and 26, and a plurality of kinds of division connectors may be substituted for the division connectors 25 and 26. Therefore, a plurality of kinds of connectors 21, having the same length, can be formed. Any of the plurality of kinds of connectors 21 can be fitted into the mating connector 23 by one lever 22, and the lever 22 can be of the common use-type.

12 Claims, 6 Drawing Sheets

LEVER FITTING-TYPE CONNECTOR WITH DIVISION CONNECTORS

BACKGROUND OF INVENTION

1. Field of invention

This invention relates to a lever fitting-type connector in which a connector is fitted into a mating connector by pivotally moving a lever mounted on the connector, and more particularly to a lever fitting-type connector in which the lever is of the common use-type.

2. Related art

FIGS. 6 and 7 show a conventional lever fitting-type connector. This lever fitting-type connector comprises a male connector 1, a lever 2 pivotally mounted on the male connector 1, and a female connector 3 into which the male connector 1 is fitted.

The male connector 1 has a plurality of terminal receiving chambers 9 for respectively receiving terminals therein, and the terminal receiving chambers 9 communicate respectively with terminal insertion ports formed in a bottom wall of the male connector. When the male connector 1 is fitted into the female connector 3, mating terminals (not shown) in the female connector 3 are inserted respectively into the terminal insertion ports, and are electrically connected respectively to the terminals received respectively in the terminal receiving chambers 9.

Bosses 5 are formed respectively on opposite side walls of the male connector 1, and are disposed generally centrally of he length of the male connector 1, and the lever 2 is supported on the bosses 5 so that the lever 2 can be pivotally moved about the bosses 5.

The lever 2 includes a pair of right and left lever walls 6, and an operating portion 7 interconnecting one end portions of the two lever walls 6. The lever walls 6 have rotation holes 8, respectively, in which the bosses 5 are inserted, respectively, so that the lever 2 can be pivotally moved about the bosses 5 along opposite side walls 4 of the male connector 1.

A lever projection 10 is formed on each of the lever walls 6, and is disposed in opposite relation to the operating portion 7 with respect to the boss 5. These lever projections 10 are retainingly engaged with retaining portions (not shown) of the female connector 3, respectively, and serve as a supporting point for the pivotal movement of the lever 2.

Projected portions 11 are formed at that end of the lever 2 remote from the operating portion 7, and slots 12, in which the projected portions 11 are slidably received, respectively, are formed in that end of the male connector 1 corresponding to the projected portions 11. The projected portions 11 are thus received respectively in the slots 12, and therefore the lever 2 is mounted on the male connector 1 against disengagement therefrom.

The female connector 3 includes a hood portion 13 with an open top, into which the male connector 1 can be fitted. Guide grooves 15 are formed in an inner surface of the hood portion 13, and extend in a direction of fitting of the male connector 1. Flange-like guide ribs 14, formed at the opposite ends of the male connector 1, can be engaged respectively in the guide grooves 15.

Because of this engagement, the male connector 1 can be fitted into the hood portion 13 without being tilted.

In this lever fitting-type connector, the lever 2 is mounted on the male connector 1, and in this condition the male connector 1 is inserted into the hood portion 13 of the female connector 3 as shown in FIG. 7. Then, the operating portion 7 is pressed to pivotally move the lever 2. As a result, the lever 2 is pivotally moved, with the bosses 5 serving as an application point while the lever projections 10 serve as the supporting point, and therefore the lever 2 and the male connector 1 are fitted in unison into the hood portion 13. In this case, thanks to the effect of leverage, the male connector 1 can be easily fitted into the hood portion 13 with a low operating force.

In such a lever fitting-type connector, the size of the male connector 1 varies depending on the number of electrically-connecting poles and the size of the terminal receiving chambers. When the size of the male connector 1 is thus changed, the position of the bosses 5, supporting the lever 2, varies, and the distance L1 between the boss 5 (serving as the application point) and the lever projection 10 (serving as the supporting point) of the lever 2 varies. The length L2 of the lever 2 is generally equal to the length L3 of the male connector 1, and therefore when the length (size) of the male connector 1 is changed for the above reason, it is necessary to change the length of the lever 2 in accordance with the length of the male connector 1.

Therefore, in the lever fitting-type connector, exclusive-use levers 2, corresponding respectively to the male connectors of different sizes, are required. Therefore, it has heretofore been necessary to prepare many kinds of levers 2 of different lengths and sizes, and the lever for exclusive use with the particular connector must be selected among many kinds of prepared levers 2, which is a cumbersome operation.

On the other hand, it may be proposed to provide a standardized lever for common use with many kinds of male connectors. However, if any of male connectors of different kinds can be fitted by the use of the same lever, there is encountered a new problem that it is possible to erroneously fit a wrong connector different in the number of poles and the size from the proper connector to be fitted.

SUMMARY OF INVENTION

It is therefore an object of this invention to provide a lever fitting-type connector in which a lever is of the type for common use with connectors of different kinds. Another object of the invention is to provide a lever fitting-type connector which prevents the fitting of a wrong connector.

According to the present invention, there is provided a lever fitting-type connector wherein a lever is pivotally mounted on bosses of a connector having a plurality of terminals received therein, and the connector is fitted into a mating connector by pivotally moving the lever about the bosses, thereby connecting the terminals respectively to terminals received in the mating connector;provided in that the connector comprises a plurality of division connectors which can be combined together; a plurality of kinds of division connectors of different lengths are prepared for each of the division connectors, and the connector, formed by combining desired ones selected respectively from the plurality of groups of division connectors, has a predetermined length, and different kinds of terminals are received in the respective division connectors; and a plurality of kinds of the connectors of the same length, each formed by combining desired ones selected respectively from the plurality of groups of division connectors, can each be fitted into the mating connector by the common lever.

In the invention, the connector can be formed by combining desired ones selected respectively from the plurality of groups of division connectors (receiving different kinds of terminals), each group having different kinds of division connectors of different lengths, and this connector can be fitted into the mating connector by the common lever. Therefore, the common lever can be suitably used for various combinations of the plurality of kinds of division connectors, and therefore the number of kinds of levers is greatly reduced, and the lever of the common use-type can be provided. In this case, the terminals of different kinds (for example, different widths) are received in the respective division connectors, and therefore the plurality of kinds of connectors can be provided.

In the lever fitting-type connector of the invention, the lever includes lever projections for engagement with the mating connector to serve as a supporting point for the pivotal movement of the lever, and an operating portion serving as a force-applying point for the pivotal movement, and the bosses are disposed between the lever projections and the operating portion.

In this construction, the bosses, serving an application point, is disposed between the supporting point and the force-applying point, and therefore a pressing force for the lever is reduced because of a leverage effect. Therefore, the fitting operation can be easily effected.

In the lever fitting-type connector of the invention, the plurality of division connectors have their respective outer shapes such that the division connectors are fittingly engaged only in corresponding portions of the mating connector, respectively.

Each of the division connectors has such an outer shape as to be fittingly engaged only in the corresponding portion of the mating connector, and therefore can not be fittingly engaged in any other portion of the mating connector. Therefore, even if the division connectors are combined together in wrong positions or in an erroneous posture, the whole of the connector can not be fitted into the mating connector, and therefore the erroneous connection of the connector can be prevented.

In the lever fitting-type connector of the invention, erroneous connection prevention means are provided on the plurality of division connectors and the mating connector so that the division connectors can be mounted in corresponding portions of the mating connector, respectively.

When the division connectors are mounted respectively in the corresponding portions of the mating connector, the erroneous connection prevention means allows the connector to be fitted into the mating connector. However, when the division connectors are mounted in other portions of the mating connector, the erroneous connection prevention means prevents the connector from being fitted into the mating connector.

In the lever fitting-type connector of the invention, the erroneous connection prevention means is in the form of an engagement rib and an engagement groove which are engageable with each other.

The engagement rib can be easily engaged in the engagement groove, and therefore the erroneous connection of the connector can be prevented with this simple construction.

DETAILED DESCRIPTION OF DISCLOSURE

Figure 1:
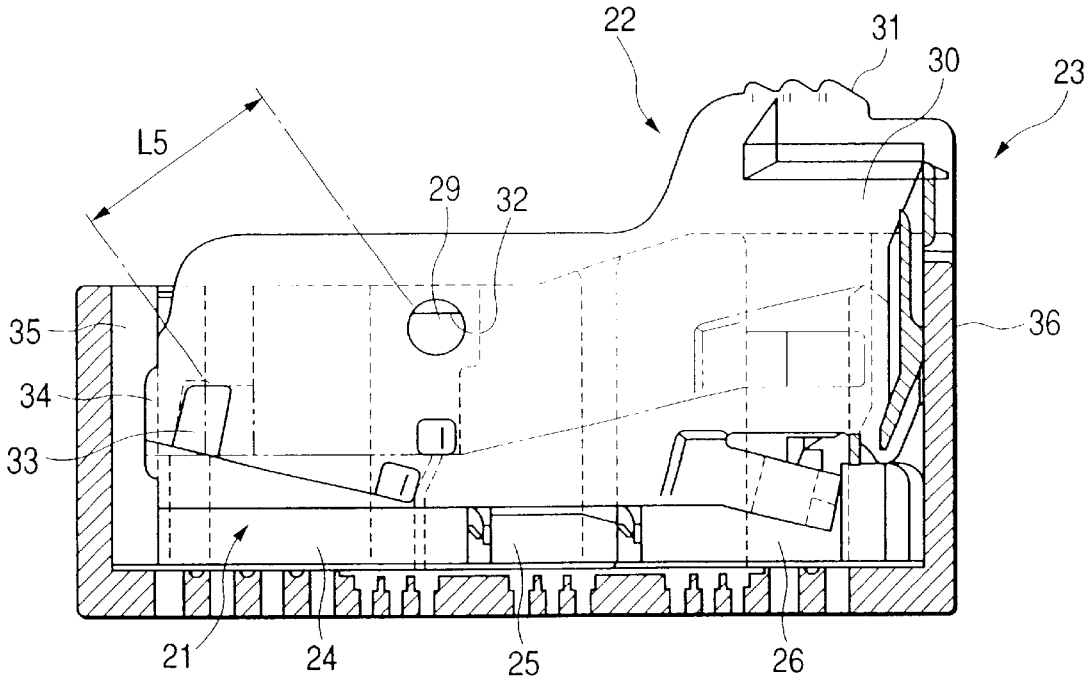
FIG. 1 is across-sectional view of one preferred embodiment of a lever fitting-type connector of the present invention in a fitted condition.
Figure 2A:
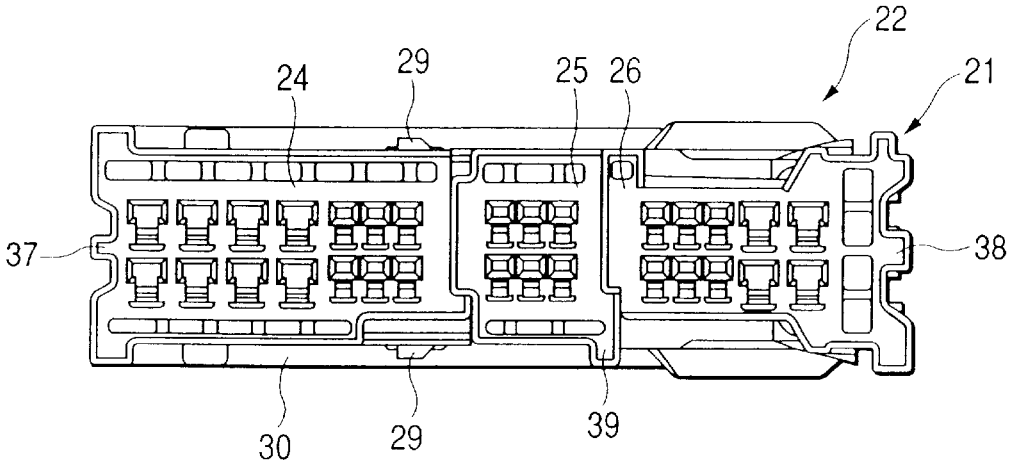
FIG. 2A is a bottom view of division connectors used in one embodiment of the invention.
Figure 2B:
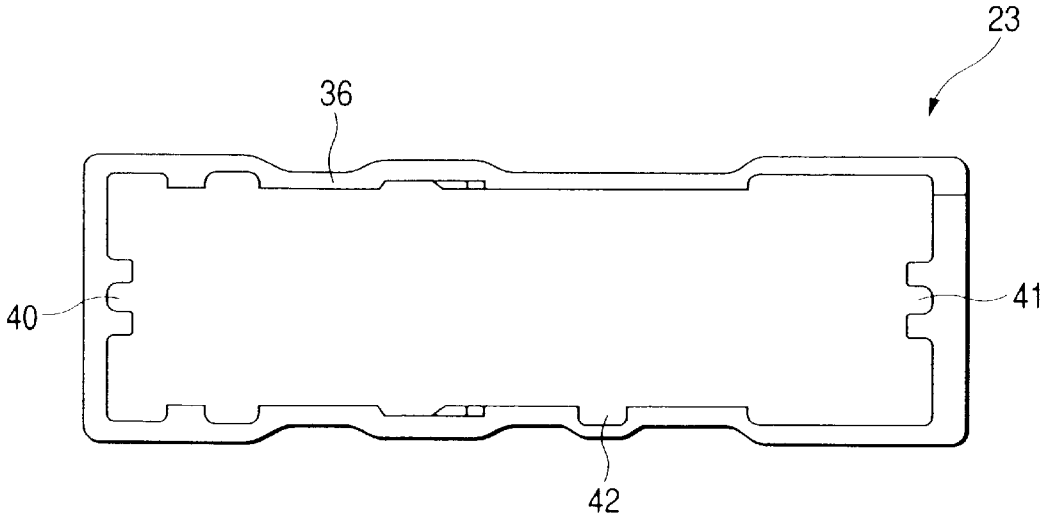
FIG. 2B is a plan view of a hood portion of a female connector.
Figure 3:
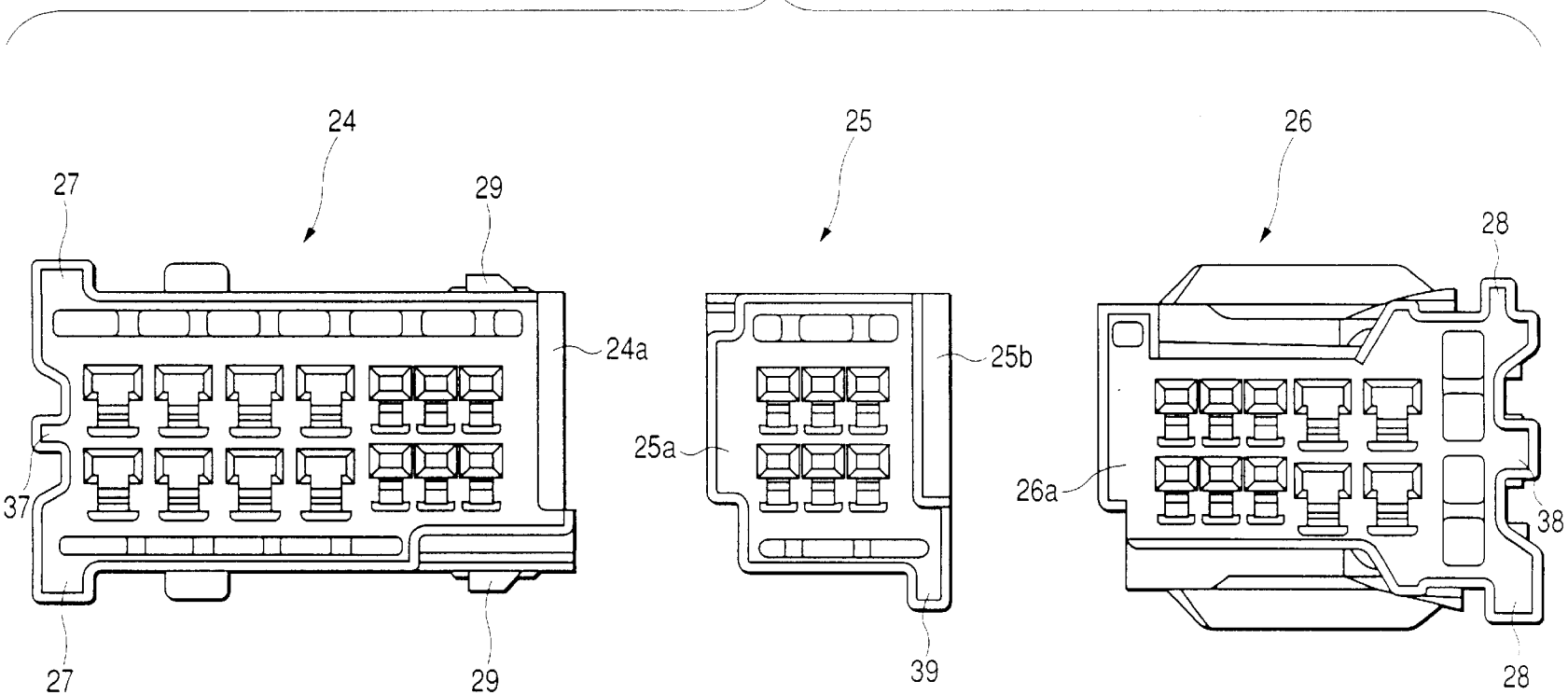
FIG. 3 is a plan view of the division connectors in an exploded condition.

FIGS. 1 to 3 show one preferred embodiment of a lever fitting-type connector 20 of the present invention. The lever fitting-type connector 20 of this embodiment comprises a male connector (connector) 21, a lever 22 pivotally mounted on the male connector 21, and a female connector (mating connector) 23 into which the male connector 21 is fitted.

The male connector 21 comprises a plurality of division connectors. In this embodiment, the male connector 21 comprises three (first, second and third) division connectors 24, 25 and 26, and the male connector 21, constituted by the division connectors 24, 25 and 25 combined together, is fitted into the female connector 23.

The division connectors 24, 25 and 26 are combined together through connecting piece portions formed respectively at corresponding portions of these division connectors. More specifically, as shown in FIG. 3, the connecting piece portions 24*a* and 25*a* are formed respectively on corresponding surfaces of the first and second division connectors 24 and 25, and can be engaged with each other by sliding the two division connectors laterally relative to each other, thereby connecting the two division connectors 24 and 25 together. Similarly, the connecting piece portions 25*b* and 26*a* are formed respectively on corresponding surfaces of the second and third division connectors 25 and 26, and can be engaged with each other by sliding the two division connectors laterally relative to each other, thereby connecting the two division connectors 25 and 26 together.

Thus, the division connectors 24, 25 and 26 can be connected together by sliding these division connectors laterally, and in this construction this connecting direction is perpendicular to the direction of fitting of the male connector 21 into the female connector 23, and therefore the division connectors 24, 25 and 26 will not be disengaged from each other during the connector fitting operation, and can be held in a stably-interconnected condition.

The division connectors 24, 25 and 26 of the male connector 21 in the combined condition have their respective outer shapes such that these division connectors are fittingly engaged only in corresponding portions of the female connector 23, respectively, when the male connector 21 is fitted into the female connector 23. More specifically, guide ribs 27 are formed respectively on opposite sides of the first division connector 24 at a front end thereof, and project in the direction of the width thereof, and the first division connector 24 can not be fittingly engaged in any portion of the female connector 23 except that these guide ribs 27 are engaged respectively in guide grooves (not shown) in the female connector 23. Similarly, guide ribs 28 are formed on and project respectively from opposite sides of the third division connector 26 at a rear end thereof, and the third division connector 26 can not be fittingly engaged in any portion of the female connector 23 except that these guide ribs 28 are engaged respectively in guide grooves (not shown) in the female connector 23.

Any such guide rib is not formed on the second division connector 25, and the second division connector 25 has such a length that the first to third division connectors 24, 25 and 26, when combined together to provide the total length, can be fitted into the female connector 23. Therefore, when the proper first to third division connectors 24, 25 and 26 are connected together, the male connector 21 can be fitted into the female connector 23. However, even if another connector, which is similar in shape to, but is different in length from the second division connector 25, is connected to the other division connectors, the male connector 21 can not be fitted into the female connector 23.

Thus, the division connectors 24, 25 and 26 have their respective outer shapes such that these division connectors are fittingly engaged only in the corresponding portions of the female connector 23, respectively, and with this construction the connection of a wrong division connector can be prevented.

In this embodiment, cylindrical bosses 29 are formed respectively on opposite side walls of the first division connector 24. The lever 22 is pivotally mounted on these bosses 29.

It is only necessary that the division connectors 24, 25 and 26, when combined together, should provide such a total length that these division connectors can be fitted into (a hood portion 36 of) the female connector 23, and all of the division connectors 24, 25 and 26 do not need to have terminal receiving chambers.

Namely, terminal receiving chambers are formed only in those division connectors required to be connected to mating terminals (not shown) in the female connector 23, and any terminal receiving chambers are not formed in that division connector not required to be connected to the mating terminals, and therefore this division connector may be a dummy connector forming part of the total length of the combined division connectors.

The bosses 29 do not always need to be formed on the first division connector 24, but may be formed on one of the other division connectors in so far as such bosses can be inserted respectively in rotation holes 32 (described later) in the lever 22.

The lever 22 includes a pair of right and left lever walls 30, and an operating portion 31 interconnecting rear end portions of the two lever walls 30. The rotation holes 32 are formed respectively through the lever walls 30, and the bosses 29 on the first division connector 24 are inserted respectively in these rotation holes 32, so that the lever 22 is pivotally supported on the male connector 21. When fitting the male connector 21 into the female connector 23, the operating portion 31 is operated or pressed to serve as a force-applying point.

Lever projections 33 are formed on front end portions of the lever walls 30, respectively. The lever projections 33 can be engaged respectively with projected retaining portions (not shown) formed on the inner surface of (the hood portion 36 of) the female connector 23. Each lever projection 33 is disposed in opposite relation to the operating portion 31 with respect to the boss 29, and these lever projections 33 are retainingly engaged with the retaining portions of the female connector 23, respectively, and serve as a supporting point for the pivotal movement of the lever 22.

Projected portions 34 are formed at that end of the lever 22 remote from the operating portion 31. As shown in FIG. 1, the projected portions 34 are received respectively in slots 35 formed in the front end of the first division connector 24, thereby preventing the disengagement of the lever 22.

The female connector 23 has the hood portion 36 with an open top, into which the male connector 21 can be fitted. The hood portion 36 has such length and width that the male connector 21, formed by combining the division connectors 24, 25 and 26 together, can be fitted into the hood portion 36.

In the above embodiment, the first to third division connectors 24, 25 and 26 are connected together to assemble the male connector 21, and then the bosses 29 on the first division connector 24 are inserted respectively into the rotation holes 32, thereby mounting the lever 22 on the male connector 21. Then, this assembly is inserted into the hood portion 36 of the female connector 23, and the operating portion 31 of the lever 22 is pressed to pivotally move the lever 22.

As a result of this pivotal movement, the lever projections 33 of the lever 22 are retainingly engaged respectively with the retaining portions of the hood portion 36, and because of its reaction force, the male connector 21, together with the lever 22, can be fitted into the hood portion 36.

As described above, the division connectors 24, 25 and 26 are fittingly engaged only in the corresponding portions of the female connector 23, respectively, and therefore the erroneous connection of the male connector will not occur, and the connector will not be erroneously fitted.

In this embodiment, further, erroneous connection prevention means are provided on the division connectors 24, 25 and 26 and the hood portion 36 of the female connector 23. More specifically, an engagement rib 37 is formed on the front wall of the first division connector 24, and an engagement rib 38 is formed on the rear wall of the third division connector 26, and an engagement rib 39 is formed on one side wall of the second division connector 25. Engagement grooves 40, 41 and 42 for respectively receiving the engagement ribs 37, 38 and 39 are formed in the inner surface of the hood portion 36.

When inserting the male connector 21 into the hood portion 36, the engagement ribs 37, 38 and 39 are engaged respectively in the engagement grooves 40, 41 and 42 so that the male connector 21 can be fitted into the hood portion 36. On the other hand, when a male connector, including other division connector, is to be inserted into the hood portion, this division connector interferes with a corresponding one of the engagement grooves 40, 41 and 42, and therefore this male connector can not be fitted into the hood portion 36. With this construction, the erroneous connection of the connector can be prevented.

Next, description will be made of kinds of connectors in which one common lever can be used.

Figure 4A:
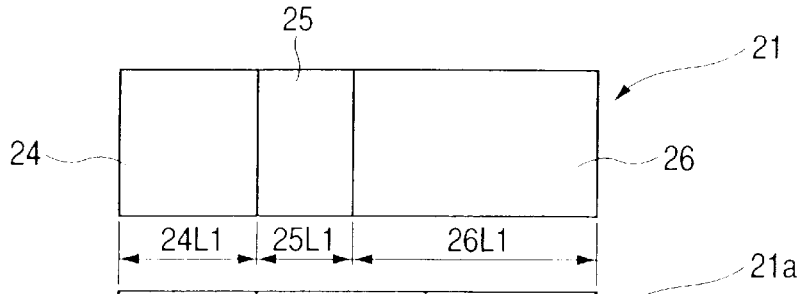
FIGS. 4A, 4B and 4C are views respectively showing three kinds of connectors which have the same length, but have different kinds of division connectors.
Figure 4B:
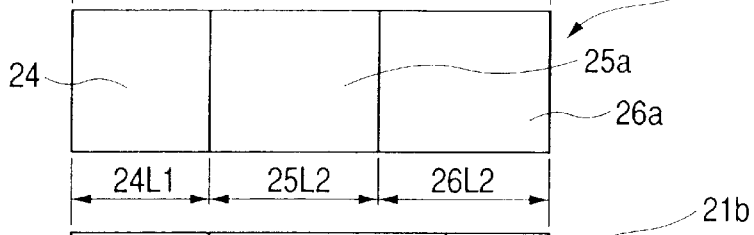
Figure 4C:
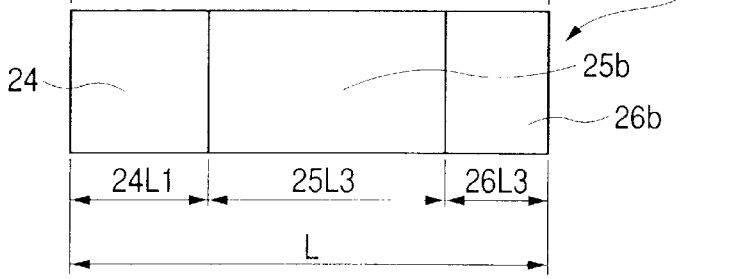

FIG. 4 shows connectors 21, 21*a* and 21*b* in which one common lever 22 can be used. The connector 21 comprises connectors 24, 25 and 26. With respect to the connectors 21 and 21*a*, the common division connector 24 is used, and the division connector 25 is replaced by a division connector 25*a*, and the division connector 26 is replaced by a division connector 26*a*.

With respect to the connectors 21 and 21*b*, the common division connector 24 is used, and the division connector 25 is replaced by a division connector 25*b*, and the division connector 26 is replaced by a division connector 26*b*. The three connectors 21, 21*a* and 21*b* have the same length, but are of different kinds since the different division connectors are used except the common division connector 24.

Terminals of the same kind (having the same width) are received in the division connectors 25 and 25*a*, but the number of the terminals, received in the division connector 25, is different from the number of the terminals received in the division connector 25*a*. Similarly, terminals of the same kind (having the same width) are received in the division connectors 26 and 26*a*, but the number of the terminals, received in the division connector 26, is different from the number of the terminals received in the division connector 26*a*.

Lengths 25L1, 25L2 and 25L3 of the division connectors 25, 25*a* and 25*b* are different in accordance with the number of the terminals to be received in these division connectors. Similarly, lengths 26L1, 26L2 and 26L3 of the division connectors 26, 26*a* and 26*b* are different in accordance with the number of the terminals to be received in these division connectors. Namely, the length of each division connector varies (that is, increases and decreases), depending on the number of the terminals to be received therein.

Figure 5:
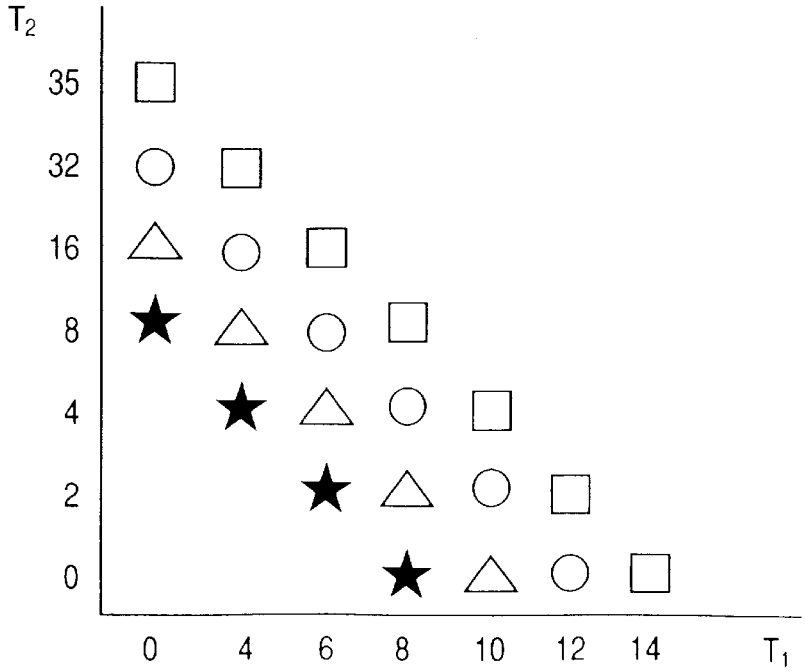
FIG. 5 is a diagram explanatory of various combinations obtained when two kinds of terminals are received in two division connectors.
Figure 6:
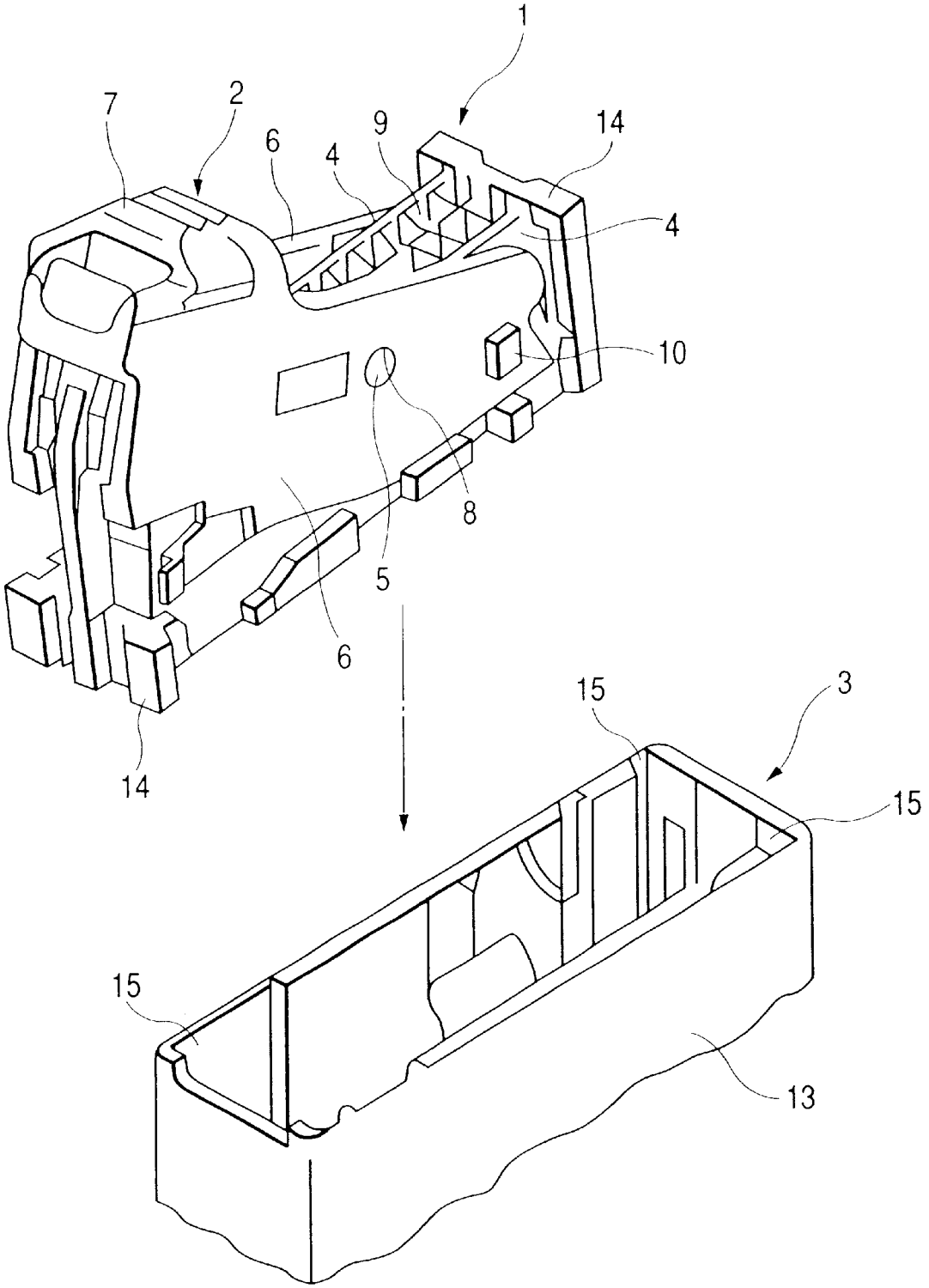
PRIOR ART FIG. 6
FIG. 6 is an exploded, perspective view of a conventional lever fitting-type connector.
Figure 7:
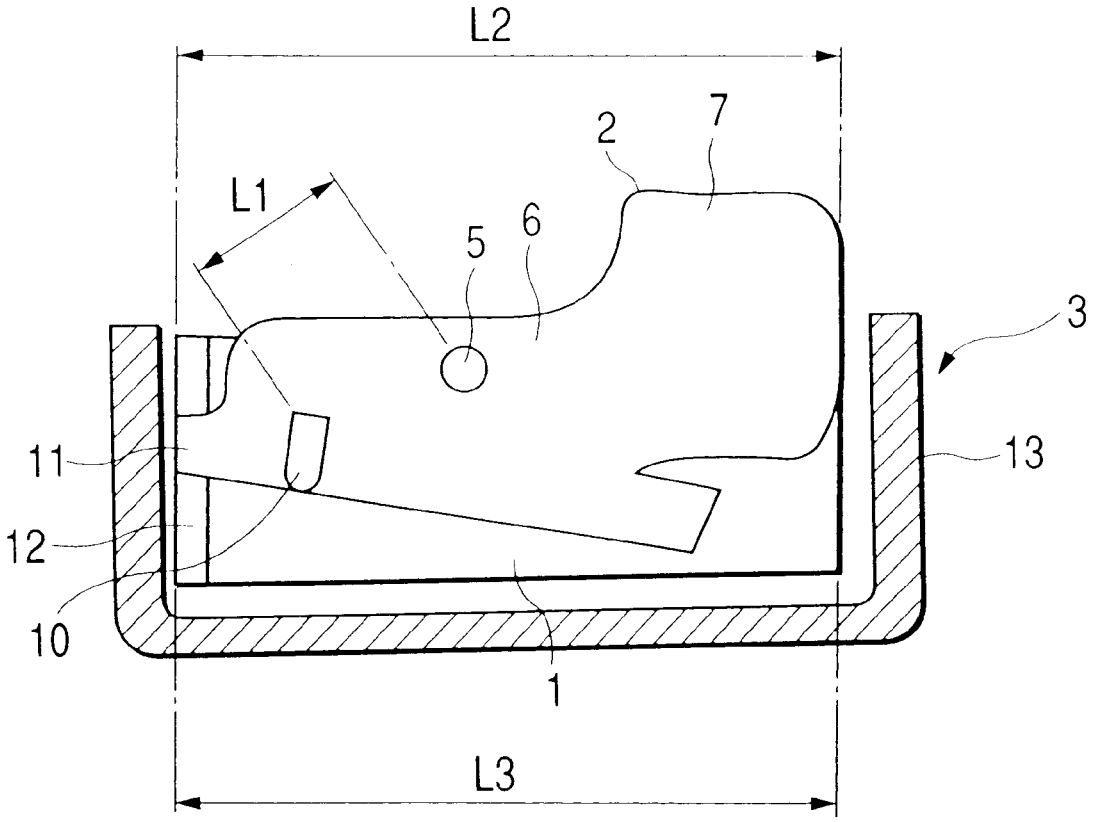
PRIOR ART FIG. 7
FIG. 7 is a cross-sectional view of the conventional lever fitting-type connector in a fitted condition.

FIG. 5 shows kinds of connectors (different in the number and kind of terminals to be received in the division connectors) in which one common lever can be used. In FIG. 5, the abscissa axis represents the number of terminals (having a width T1) received in the division connector 26, and the ordinate axis represents the number of terminals (having a width T2) received in the division connector 25.

For example, with respect to symbols ★ in FIG. 5, if 6 terminals of the width T1 are received in the division connector 26, 2 terminals with the width T2 are received in the division connector 25.

Thus, there can be provided different kinds of connectors 21, 21*a* and 21*b* (which have the same length) whose number corresponds to the number (4 as represented by symbols ★ in FIG. 5) of the combinations of two kinds of terminals received in the division connectors 25 and 26.

Similarly, in the case of providing the connectors 21, 21*a* and 21*b* (having an increased length) by combining a plurality of division connectors, there can be provided different kinds of such connectors (which have the same length) whose number corresponds to the number (as represented by 5 symbols Δ, 6 symbols ○ and 7 symbols □ in FIG. 5) of the combinations of two kinds of terminals received in the division connectors 25 and 26.

The common lever 22 can be used in the connectors having the same length, and therefore the common lever can be used in a plurality of connectors. As a result, the number of kinds of levers can be greatly reduced.

The present invention is not limited to the above embodiment, and various modifications can be made. For example, the number of the division connectors is not limited to three, and should be at least two.

In the present invention, the connector can be formed by combining desired ones selected respectively from the plurality of groups of division connectors (receiving different kinds of terminals), each group having different kinds of division connectors of different lengths, and this connector can be fitted into the mating connector by the common lever. Therefore, the common lever can be suitably used for various combinations of the plurality of kinds of division connectors, and therefore the number of kinds of levers is greatly reduced, and the lever of the common use-type can be provided.

In the present invention, the pressing force for the lever is reduced because of a leverage effect, and therefore, the connector can be easily fitted.

In the present invention, each of the division connectors has such an outer shape as to be fittingly engaged only in the corresponding portion of the mating connector, and therefore the erroneous connection of the connector can be prevented.

In the present invention, because of the provision of the erroneous connection prevention means, the erroneous connection of the connector is prevented.

In the present invention, the erroneous connection of the connector can be prevented with the simple construction.

What is claimed is:

1. A lever fitting-type connector comprising:

a unitary connector comprising a plurality of division connectors which can be combined together, said division connectors selected from a plurality of kinds of division connectors of different lengths, said unitary connector formed by combining said selected division connectors and having a predetermined length;

different kinds of terminals received in the plurality of division connectors; and a lever pivotally mounted on bosses of said unitary connector having a plurality of terminals received therein, and said unitary connector being fitted into a mating connector by pivotally moving said lever about said bosses to connect said terminals respectively to terminals received in said mating connector, wherein a second unitary connector having the predetermined length, and formed by combining different selected division connectors from the plurality of kinds of said division connectors, can be fitted into said mating connector by the lever.

2. A lever fitting-type connector according to claim 1, in which said lever includes lever projections for engagement with said mating connector to serve as a supporting point for the pivotal movement of said lever, and an operating portion serving as a force-applying point for said pivotal movement, and said bosses are disposed between said lever projections and said operating portion.

3. A lever fitting-type connector according to claim 1, in which said plurality of division connectors have their respective outer shapes such that said division connectors are fittingly engaged only in corresponding portions of said mating connector, respectively.

4. A lever fitting-type connector according to claim 2, in which said plurality of division connectors have their respective outer shapes such that said division connectors are fittingly engaged only in corresponding portions of said mating connector, respectively.

5. A lever fitting-type connector according to claims 1, further comprising:

erroneous connection prevention means, provided on said plurality of division connectors and said mating connector, for mounting said division connectors in corresponding portions of said mating connector, respectively.

6. A lever fitting-type connector according to claims 2, further comprising:

erroneous connection prevention means, provided on said plurality of division connectors and said mating connector, for mounting said division connectors in corresponding portions of said mating connector, respectively.

7. A lever fitting-type connector according to claim 3, further comprising:

erroneous connection prevention means, provided on said plurality of division connectors and said mating connector, for mounting said division connectors in corresponding portions of said mating connector, respectively.

8. A lever fitting-type connector according to any one of claim 4, further comprising:

erroneous connection prevention means, provided on said plurality of division connectors and said mating connector, for mounting said division connectors in corresponding portions of said mating connector, respectively.

9. A lever fitting-type connector according to claim 5, in which said erroneous connection prevention means is in the form of an engagement rib and an engagement groove which are engageable with each other.

10. A lever fitting-type connector according to claim 6, in which said erroneous connection prevention means is in the form of an engagement rib and an engagement groove which are engageable with each other.

11. A lever fitting-type connector according to claim 7, in which said erroneous connection prevention means is in the form of an engagement rib and an engagement groove which are engageable with each other.

12. A lever fitting-type connector according to claim 8, in which said erroneous connection prevention means is in the form of an engagement rib and an engagement groove which are engageable with each other.

* * * * *